US009233734B2

(12) United States Patent
Erskine et al.

(10) Patent No.: US 9,233,734 B2
(45) Date of Patent: Jan. 12, 2016

(54) WINDSHIELD SLIDING DOOR/WINDOW ASSEMBLY

(71) Applicant: Taylor Made Group, LLC, Gloversville, NY (US)

(72) Inventors: Edward J. Erskine, Benson, NY (US); Michael Trajlinek, Johnstown, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 14/290,285

(22) Filed: May 29, 2014

(65) Prior Publication Data

US 2014/0352600 A1 Dec. 4, 2014

Related U.S. Application Data

(60) Provisional application No. 61/828,296, filed on May 29, 2013.

(51) Int. Cl.

| | |
|---|---|
| ***B63B 19/02*** | (2006.01) |
| ***B63B 19/18*** | (2006.01) |
| ***E05F 1/16*** | (2006.01) |
| ***E05F 1/08*** | (2006.01) |

(52) U.S. Cl.

CPC ..... *B63B 19/02* (2013.01); *B63B 19/18* (2013.01); *E05F 1/08* (2013.01); *E05F 1/16* (2013.01)

(58) Field of Classification Search

CPC ..... E05F 1/16; E05F 1/08; E05F 15/665; E05F 15/67; E05F 15/681; E05F 15/686; F16F 9/00; B63B 19/02; B63B 19/18; B63B 19/185

USPC ..... 49/139, 140

See application file for complete search history.

(56) References Cited

U.S. PATENT DOCUMENTS

| | | | | |
|---|---|---|---|---|
| 3,161,895 | A * | 12/1964 | Lewis | 114/361 |
| 4,301,623 | A * | 11/1981 | Demukai | 49/404 |
| 4,452,013 | A * | 6/1984 | Nagata | 49/344 |
| 4,685,411 | A * | 8/1987 | Wick | 114/202 |
| 4,811,680 | A * | 3/1989 | Genth | 114/201 R |
| 4,819,295 | A * | 4/1989 | Kaftan | 16/72 |
| 5,131,188 | A * | 7/1992 | Hutchison et al. | 49/404 |
| 5,142,824 | A | 9/1992 | Le Compagnon et al. | |
| 5,365,636 | A * | 11/1994 | Jensen | 16/67 |
| 5,784,833 | A | 7/1998 | Sponable et al. | |
| 5,799,449 | A | 9/1998 | Lyons et al. | |
| 5,822,922 | A | 10/1998 | Grumm et al. | |
| 6,026,611 | A | 2/2000 | Ralston et al. | |
| 6,209,477 | B1 * | 4/2001 | Biedenweg | 114/361 |
| 7,185,943 | B2 | 3/2007 | Lesle et al. | |
| 7,421,969 | B2 * | 9/2008 | Mercier et al. | 114/361 |

(Continued)

FOREIGN PATENT DOCUMENTS

FR 2548129 A1 * 1/1985 ..... B63B 19/18

*Primary Examiner* — Katherine Mitchell
*Assistant Examiner* — Marcus Menezes
(74) *Attorney, Agent, or Firm* — Nixon & Vanderhye P.C.

(57) ABSTRACT

A sliding window assembly includes a window frame and a window cooperable with the window frame and displaceable on the window frame between an open position and a closed position. Operating components of the assembly include a counterbalance connected between the window frame and the window and an optional motor that drives a cable connected to the window. The counterbalance is biased to assist the motor in displacing the window relative to the window frame toward the open position.

16 Claims, 7 Drawing Sheets

(56) References Cited

U.S. PATENT DOCUMENTS

| | | | | |
|---|---|---|---|---|
| 7,464,501 | B2 | 12/2008 | Arimoto et al. | |
| 7,509,773 | B2 | 3/2009 | Vornbaumen et al. | |
| 7,568,312 | B2 | 8/2009 | Dufour et al. | |
| 8,033,055 | B2 * | 10/2011 | Oberheide | B60J 5/101 296/56 |
| 8,627,607 | B2 | 1/2014 | Schulte et al. | |
| 2007/0011946 | A1 * | 1/2007 | Mullen et al. | 49/325 |
| 2010/0122493 | A1 * | 5/2010 | Burrows | 49/358 |

* cited by examiner

WINDSHIELD SLIDING DOOR/WINDOW ASSEMBLY

CROSS-REFERENCES TO RELATED APPLICATIONS

This application claims the benefit of U.S. Provisional Patent Application Ser. No. 61/828,296, filed May 29, 2013, the entire content of which is herein incorporated by reference.

STATEMENT REGARDING FEDERALLY SPONSORED RESEARCH OR DEVELOPMENT (Not applicable)

BACKGROUND OF THE INVENTION

The invention relates generally to a door/window for a boat and, more particularly, to a sliding door assembly for a boat.

A powered door assembly is a desirable feature for a boat windshield including a pass-through. A boat passenger can press a button on either side of the door/window to activate a motor that opens or closes the door assembly. Challenges in the design relate to positioning the drive components, accommodating the weight of the door, providing for a safety release, enabling component access for repair or replacement if necessary, etc.

BRIEF SUMMARY OF THE INVENTION

It would be desirable for a powered door/window assembly to address the noted design challenges. The door/window assembly according to preferred embodiments includes strategically positioned drive components that are hidden from view but are accessible from inside the structure in the event that one or more components need service or repair. Additionally, the assembly incorporates a counter balance such as a gas spring that assists the optional motor (or manual operation) in opening the door/window. The assembly also includes a safety release in the event of motor failure. Additionally, the counter balance is connected to the door/window via a block and tackle that amplifies a stroke output of the gas spring.

In an exemplary embodiment, a sliding window assembly is provided for a boat including a boat roof with a basin for receiving the sliding window assembly. The sliding window assembly includes a window frame secured in the basin, a component box housing operating parts for the sliding window assembly, and a window cooperable with the window frame and displaceable on the window frame between an open position and a closed position. The operating parts are cooperable with the window to facilitate displacement of the window. The operating parts include a carriage assembly connected to the window and engaged with the window frame and a counterbalance, such as a gas spring or the like, connected to the carriage assembly and biasing the window toward the open position.

The operating parts may include a motor driving a main cable to which the carriage assembly is connected. The main cable may include a spiral wound wire, and the operating parts may further include a gear engaging the spiral wound wire. The motor engages the gear to drive the main cable in forward and reverse directions. The carriage assembly may include a safety release that detaches the main cable from the window.

The counterbalance may be connected to the carriage through a block and tackle. In this context, the block and tackle may include a fixed pulley secured to the window frame, a movable pulley displaceable in or on a track, and a pulley cable wound over the fixed pulley and the movable pulley and secured at an end to the window. The counterbalance may act between the fixed pulley and the movable pulley and may be configured to bias the fixed pulley and the movable pulley apart. The pulley cable may be wrapped in multiple loops over the fixed pulley and the movable pulley. The movable pulley may be coupled with a bearing car displaceable in the track. The operating parts may include a motor driving a main cable to which the carriage assembly is connected.

In another exemplary embodiment, a boat includes a boat roof with a basin, and the sliding window assembly disposed in the basin. The operating parts may be configured such that they are accessible from inside the boat. A cover may be installed over the window frame that covers at least a portion of the window frame including the operating parts, where the cover is generally coplanar with the boat roof.

In yet another exemplary embodiment, a sliding window assembly includes a window frame, a window cooperable with the window frame and displaceable on the window frame between an open position and a closed position, and operating components including a counterbalance connected between the window frame and the window and a motor that drives a cable connected to the window. The counterbalance may be biased to assist the motor in displacing the window relative to the window frame toward the open position.

In still another exemplary embodiment, a sliding window assembly is provided for a boat including a boat roof with a basin for receiving the sliding window assembly. The sliding window assembly includes a window frame secured in the basin; a component box housing operating parts for the sliding window assembly; and a window cooperable with the window frame and displaceable on the window frame between an open position and a closed position. The operating parts are cooperable with the window to facilitate displacement of the window. The operating parts include a carriage assembly connected to the window and engaged with the window frame and a motor driving a gear engaged with a cable to which the carriage assembly is connected.

BRIEF DESCRIPTION OF THE DRAWINGS

These and other aspects and advantages will be described in detail with reference to the accompanying drawings, in which.

DETAILED DESCRIPTION OF THE INVENTION

Throughout the description, references to the assembly will be described in the context of a window assembly. The assembly is equally applicable to a door or pass-through construction, and the invention is not meant to be limited. For purposes of this description, any reference to a window, window frame, window assembly or the like is intended to encompass equivalent structures associated with a door.

Figure 1:
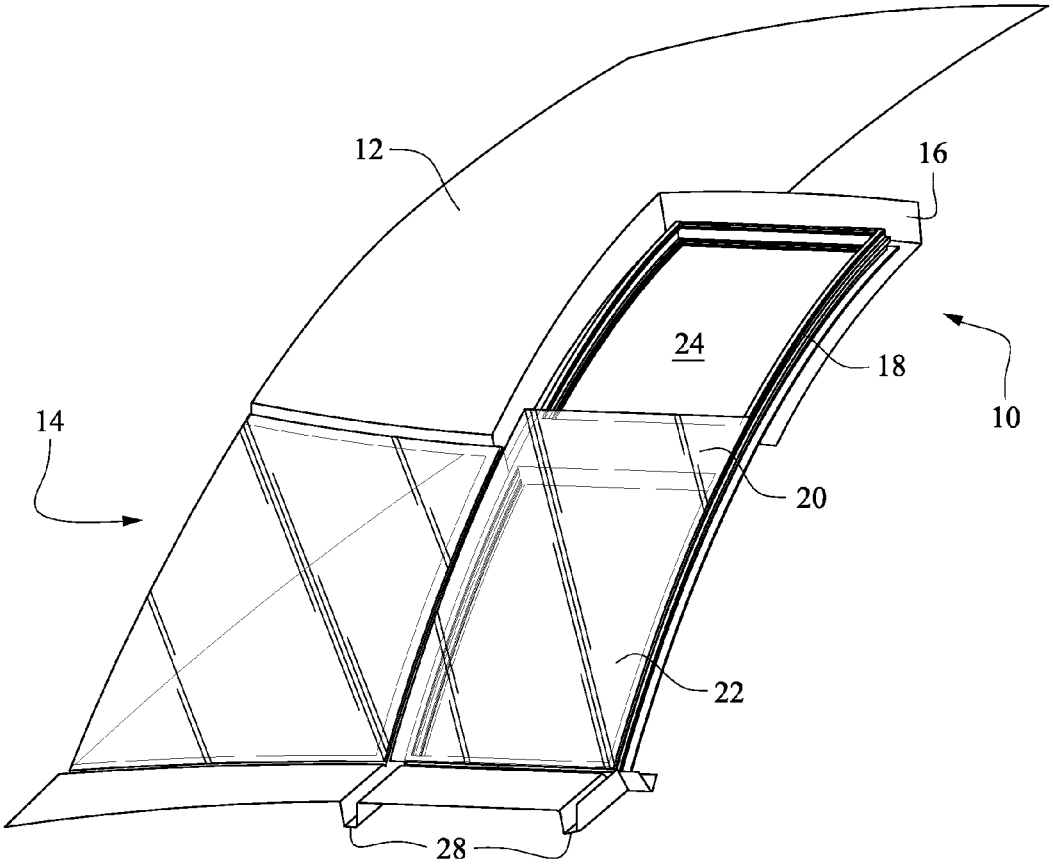
FIG. 1 is a perspective view of the door/window assembly cooperable with a boat roof and incorporated as part of a windshield assembly.
Figure 2:
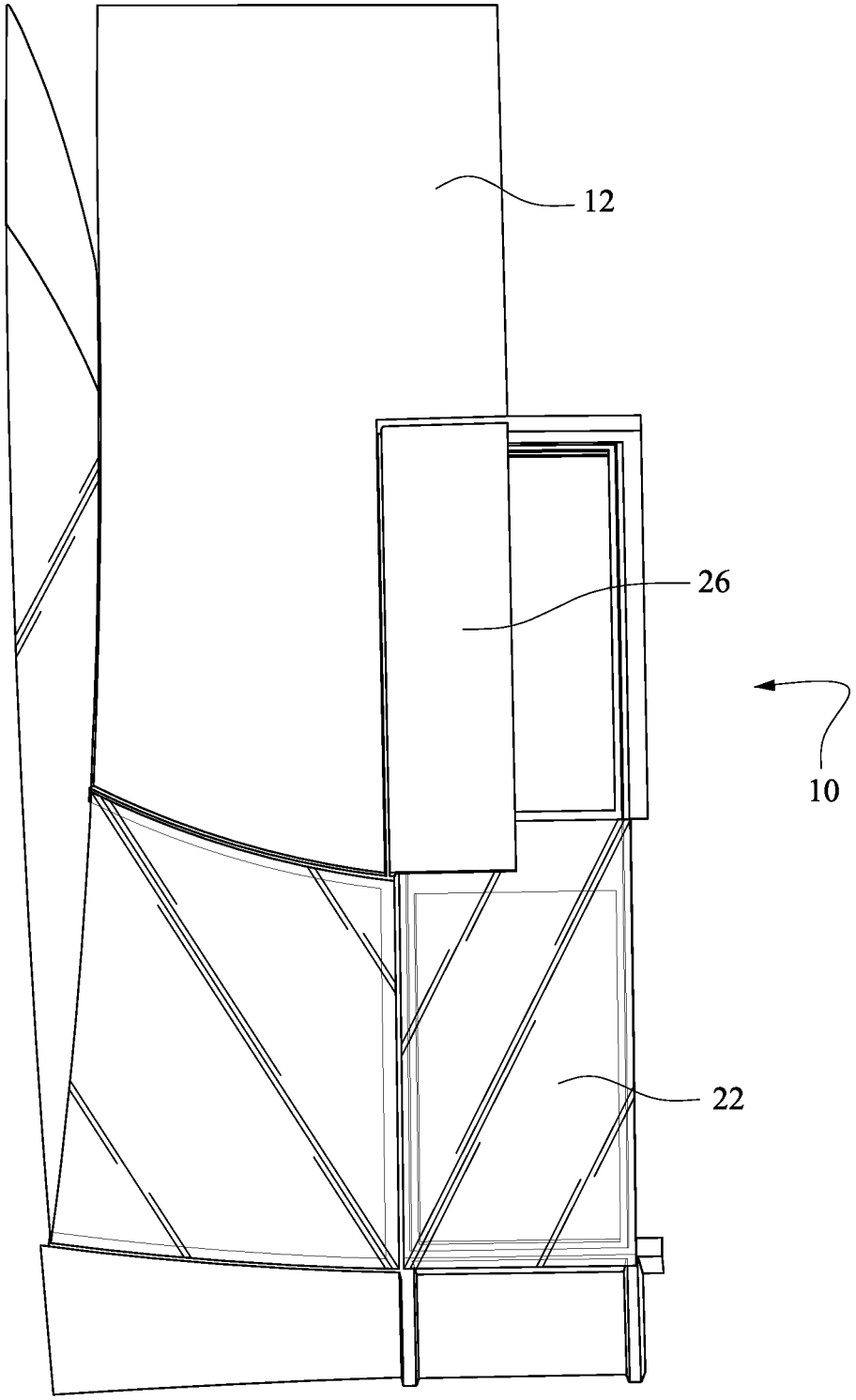
FIG. 2 is a top plan view of the assembly.
Figure 3:
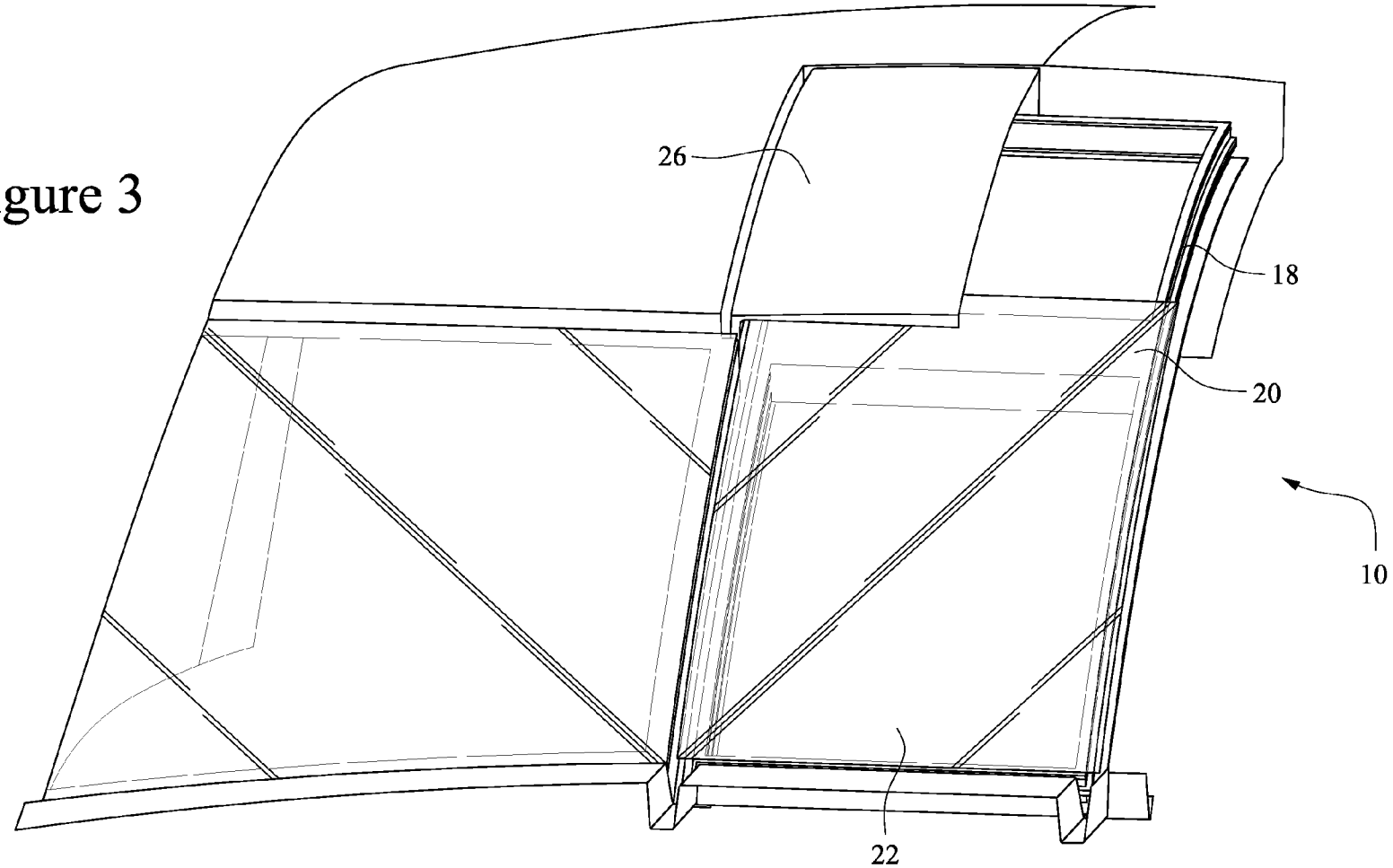
FIG. 3 is a front view of the assembly.

FIG. 1 is a perspective view of the assembly 10 cooperable with a boat roof 12 and incorporated as part of a windshield assembly 14. FIG. 2 is a top plan view, and FIG. 3 is a front view. Generally, the boat roof 12 is formed of fiberglass and includes a basin or depression 16 in which the window assembly 10 is installed. The window assembly 10 includes a window frame 18, a component box 20, which houses the driving mechanisms, and a glass door/window 22 supported on a subframe 23. The window 22 and subframe 23 are displaceable between a closed position (shown in FIG. 1) over the component box 20 and an open position in which the window 22 is disposed over an upper part 24 of the frame 18. After the assembly 10 is installed in the basin 16, a cover 26 (shown partially in FIGS. 2 and 3) is installed over the frame 18 generally coplanar with the boat roof 12. With the cover 26 in place, the window 22 and subframe 23 appear to open by sliding up into the roof.

Figure 5:
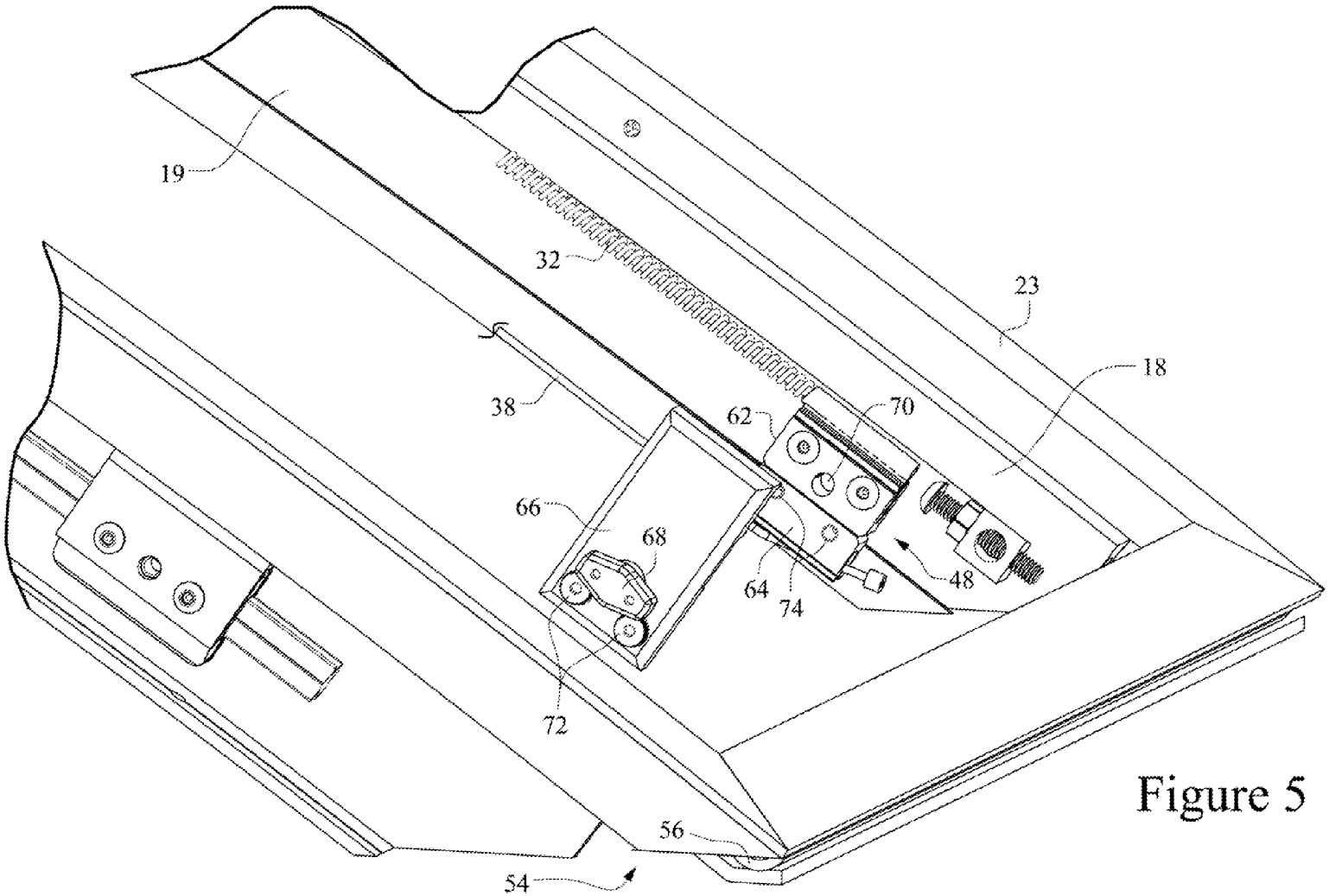
FIG. 5 shows the main cable and the carriage assembly.

The window assembly 10, the basin 16, the roof 12 and the cover 26 are fluid sealed to prevent water from entering the cabin. Sealed tracks on either side of the door assembly 10 may direct water to drains 28 adjacent a bottom of the door assembly 10. Alternatively, as shown in FIG. 5, a bottom 54 of the assembly may be formed at an angle so that the assembly sits flush on the boat deck. A foam seal 56 prevents water leakage.

The component box 20 is shown disposed in a middle of the frame 18. Preferably, the component box 20 is welded into the center of the frame 18. Although the component box 20 can be positioned anywhere in the frame 18, the middle section can be covered by the cover 26 while being accessible from inside the cabin in the event that any of the drive components requires repair or replacement.

Figure 4:
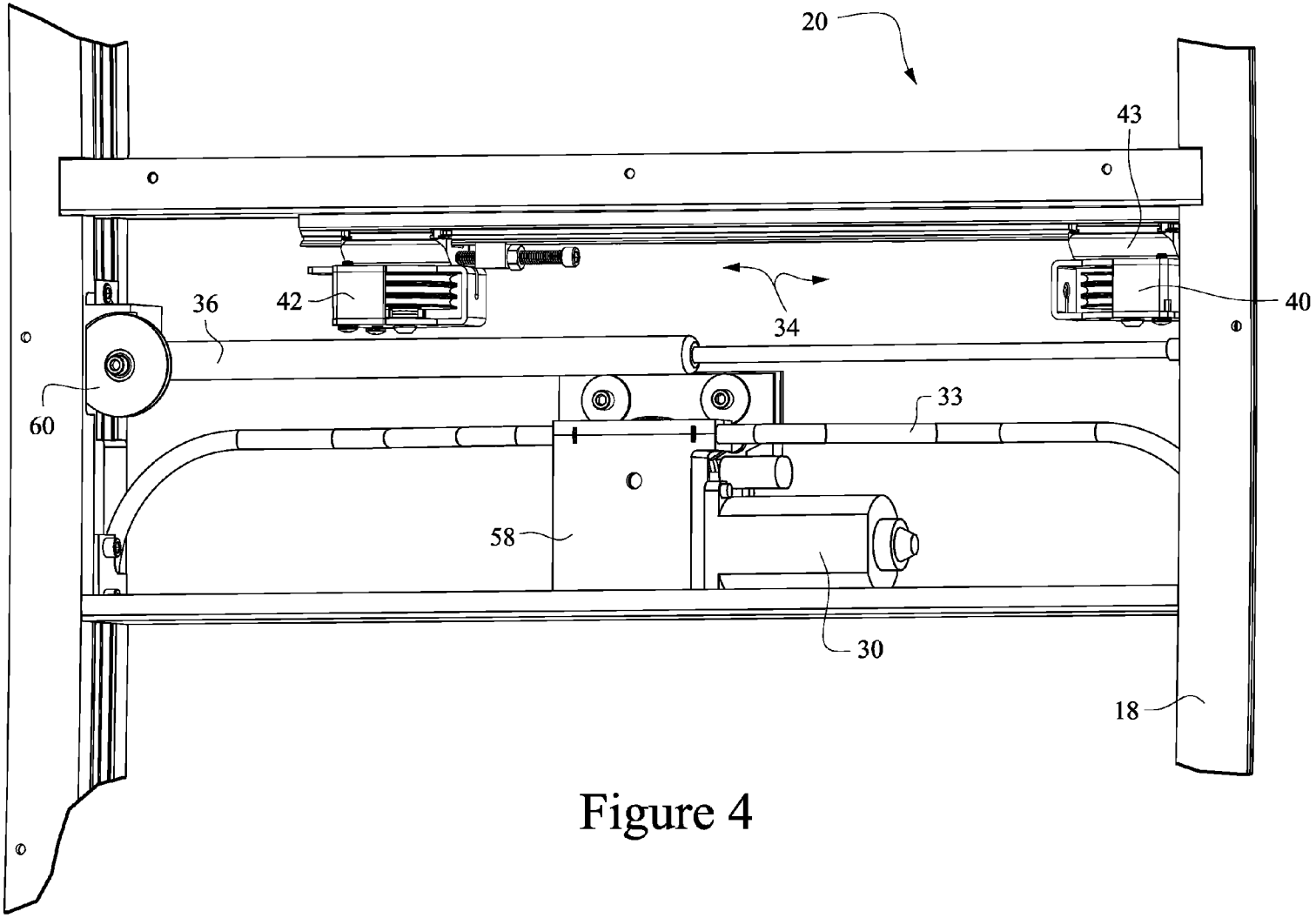
FIG. 4 shows the motor box assembly.

Any suitable components for driving the glass window 22 and subframe 23 between open and closed positions can be provided, and the invention is not meant to be limited to the described/illustrated structure. FIG. 4 shows the component box 20 with an exemplary drive system. The view in FIG. 4 is from inside the cabin looking up into the component box 20 with a component box cover removed.

With reference to FIGS. 4 and 5, the window assembly is powered by a motor 30 that drives a steel cable 32 (FIG. 5) attached to a two-piece block 48, which can slide in a track extrusion 19 (discussed in more detail below). The cable 32 in the component box 20 is housed in a cable tube 33 that directs the cable from the component box 20 into a track in the track extrusion 19. In an exemplary embodiment, the steel cable 32 is wrapped with a metal wire that is secured to the cable, defining a rack gear. The spiral wound cable 32 can be seen in FIG. 5, which shows the track extrusion 19. The motor 30 drives a gear (disposed in a gear housing 58) that engages the spiral wound metal wire wrapped on the steel cable 32. The motor 30 is operable in forward and reverse directions to drive the cable 32 and thereby open and close the window 22.

Figure 7:
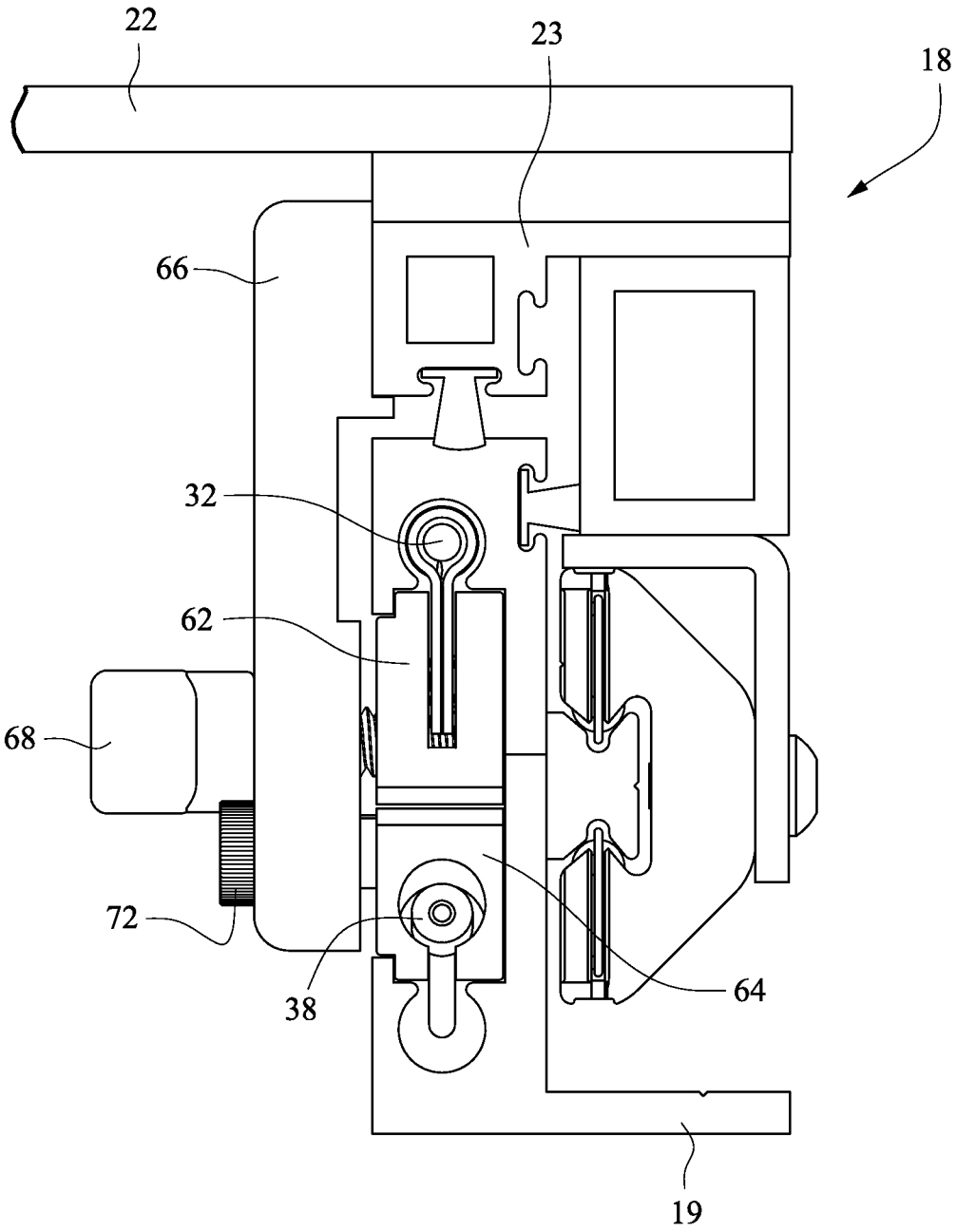
FIG. 7 is a sectional view of the carriage assembly.

From the component box 20, the spiral wound cable 32 extends down a track in the track extrusion 19 into engagement with the two-piece block 48. Specifically, the cable 32 is secured in an upper block 62 (preferably formed of plastic). A lower block 64 (preferably formed of plastic) is cooperable with the upper block 62 and is displaceable in a channel in the track extrusion 19 (see FIG. 7). A connecting plate 66 (preferably formed of aluminum) is fixed (e.g., welded) to the subframe 23. The connecting plate 66 acts to secure the upper and lower blocks 62, 64 together. The connecting plate 66 includes a knob 68 that extends through a threaded opening in the plate 66 and engages a hole 70 in the upper block 62. Two connectors 72 such as screws or the like extend through the connecting plate 66 into threaded holes 74 in the lower block 64. The block 48 including the upper block 62 and the lower block 64 along with the connecting plate 66 together define a carriage assembly. As the motor 30 drives the spiral wound cable 32, the cable 32 displaces the carriage assembly to open or close the window 22. A cross-section of the carriage assembly is shown in FIG. 7. In the event of motor failure or if it is otherwise desirable to displace the window manually, the window assembly can be released from the cable 32 by disconnecting the knob 68. The knob 68 thus acts as a safety release for the window.

Figure 6:
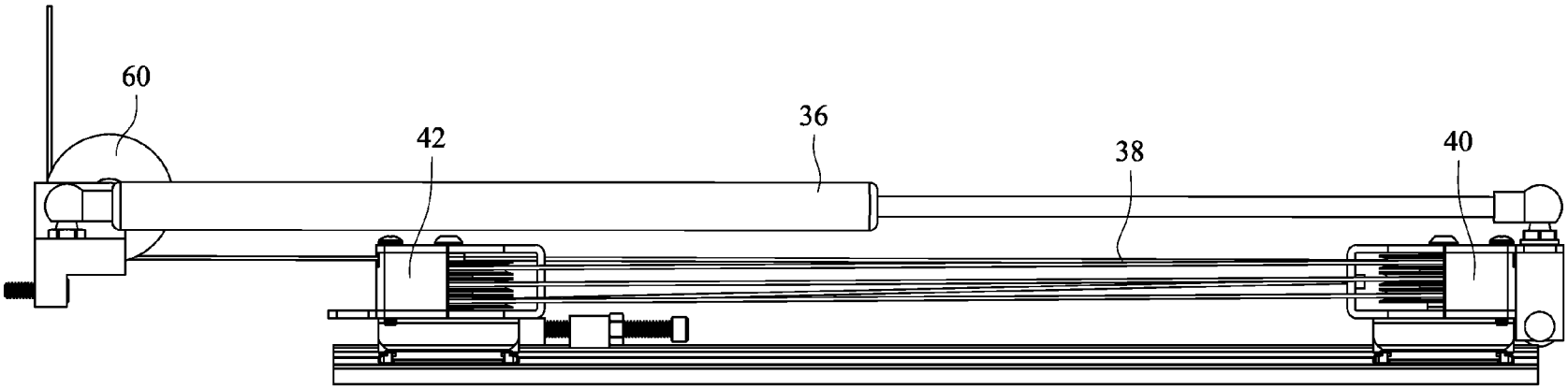
FIG. 6 is a side view of the counterbalance and the block and tackle.

With continued reference to FIG. 4 and with reference to FIG. 6, the drive components also include a block and tackle 34 with a counterbalance 36 that serves to counterbalance the weight of the window 22 and subframe 23. The counterbalance 36 may be any suitable structure, and in a preferred embodiment is a gas spring. Other structures including various spring configurations may be contemplated, and the invention is not meant to be limited. A cable 38 is wound over a series of pulleys 40, 42 and over a turning pulley 60 before extending into a track in the track extrusion 19 and being secured in a slot in the lower block 64 (see FIG. 5). The pulleys 40, 42 are displaceable relative to each other and serve to increase the stroke of the counterbalance 36. In a preferred arrangement, the pulley 40 on the right in FIG. 4 is attached to a movable carriage 43 such as a linear bearing or the like, and the pulley 42 on the left in FIG. 4 is fixed in the frame 18. The counterbalance 36 is biased open, that is, pushing the pulleys 40, 42 apart. The cable 38 is wrapped in multiple loops/spans to multiply the stroke of the counterbalance 36. For example, with five loops, a 10" stroke on the counterbalance 36 results in 50" of window displacement. The number of loops needed is dependent on the stroke and width of the window. Additionally, the multiple loops of cable 38 serve to distribute the load such that a fraction (depending on the number of loops) of the counterbalance force is supported on each of the loops. With the counterbalance 36 biased open, the motor power required to open the window 22 is lower than the motor power required to close the window 22. In this manner, the weight of the window can be used to facilitate closing, and closing the window can be more easily controlled by controlling amperage to the motor 30.

As an alternative to the motor 30 and steel cable 32, a cable drum (not shown) may be used. Still other alternatives may be suitable. Additionally, the sliding window assembly can be installed without the motor 30 and operable only in a manual mode with the counterbalance 36 and the pulley/cable assembly 38, 40, 42. The sliding window assembly may also be constructed with a motor and without a counterbalance.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A sliding window assembly for a boat including a boat roof with a basin for receiving the sliding window assembly, the sliding window assembly comprising:

a window frame secured in the basin;

a component box housing operating parts for the sliding window assembly; and a window operatively coupled with the window frame and displaceable on the window frame between an open position and as closed position, wherein the operating parts are cooperable with the window to facilitate displacement of the window, the operating parts including a carriage assembly connected to the window and engaged with the window frame, a counterbalance connected to the carriage assembly and biasing the window toward the open position, and a motor driving a drive cable to which the carriage assembly is connected, wherein the carriage assembly comprises a safety release assembly that detaches the drive cable from the window while keeping the counterbalance connected to the carriage assembly, wherein the safety release assembly includes an upper block, a lower block and a connecting plate, the upper and lower blocks being displaceable in a track in the window frame, wherein the connecting plate is fixed to the window and connected to the upper and lower blocks, and wherein the drive cable is secured to one of the upper and lower blocks, and wherein the counterbalance is mounted to the other of the upper and lower blocks, the connecting plate being selectively releasable from the upper or lower block that is secured to the drive cable to thereby disconnect the motor from the carriage assembly.

2. The sliding window assembly according to claim 1, wherein the drive cable comprises a spiral wound wire, and wherein the operating parts further comprise a gear engaging the spiral wound wire, the motor engaging the gear to drive the drive cable in forward and reverse directions.

3. The sliding window assembly according to claim 1, wherein the counterbalance is connected to the carriage assembly through a block and tackle.

4. The sliding window assembly according to claim 3, wherein the block and tackle comprises:

a fixed pulley secured to the window frame;

a movable pulley displaceable in or on a track; and at pulley cable wound over the fixed pulley and the movable pulley and secured at an end to the window, wherein the counterbalance applies at force between the fixed pulley and the movable pulley and is configured to bias the fixed pulley and the movable pulley apart.

5. The sliding window assembly according to claim 4, wherein the pulley cable is wrapped in multiple loops over the fixed pulley and the movable pulley.

6. The sliding window assembly according, to claim 5, wherein the movable pulley is coupled with a bearing car displaceable in the track.

7. The sliding window assembly according to claim 1, wherein the counterbalance comprises a gas spring.

8. A boat comprising:

a boat root with a basin; and a sliding window assembly disposed in the basin, the sliding window assembly including:

a window frame secured in the basin, a component box housing operating parts for the sliding window assembly, and a window operatively coupled with the window frame and displaceable on the window frame between an open position and a closed position, wherein the operating parts are cooperable with the window to facilitate displacement of the window, the operating parts including a carriage assembly connected to the window and engaged with the window frame, a counterbalance connected to the carriage assembly and biasing the window toward the open position and a motor driving a drive cable to which the carriage assembly is connected, wherein the carriage assembly comprises a safety release assembly that detaches the drive cable from the window while keeping the counterbalance connected to the carriage assembly, wherein the safety release assembly includes an upper block, a lower block and a connecting plate, the upper and lower blocks being displaceable in a track in the window frame, wherein the connecting plate is fixed to the window and connected to the upper and lower blocks, and wherein the drive cable is secured to one of the upper and lower blocks, and wherein the counterbalance is mounted to the other of the upper and lower blocks, the connecting plate being selectively releasable from the upper or lower block that is secured to the drive cable to thereby disconnect the motor from the carriage assembly.

9. The boat according to claim 8, wherein the operating parts are configured such that the operating parts are accessible from inside the boat.

10. The boat according to claim 8, further comprising a cover installed over the window frame and covering at least a portion of the window frame including the operating parts, wherein the cover is generally coplanar with the boat roof.

11. The boat according to claim 8, wherein the counterbalance comprises a gas spring.

12. A sliding window assembly comprising:

a window frame;

a window operatively coupled with the window frame via a subframe and displaceable on the window frame with the subframe between an open position and a closed position;

a carriage assembly including an upper block, a lower block and a connecting plate, wherein the upper and lower blocks are displaceable in a track in the window frame, and wherein the connecting plate is fixed to the subframe and connected to the upper and lower blocks; and operating components including a counterbalance connected between the window frame and the carriage assembly and a motor that drives a cable connected to the carriage assembly, wherein the counterbalance is biased to assist the motor in displacing the window via the carriage assembly relative to the window frame toward the open position, wherein the cable is secured to one of the upper and lower blocks, and wherein the counterbalance is mounted to the other of the upper and lower blocks, the connecting plate being selectively releasable from the upper or lower block that is secured to the cable to thereby disconnect the motor from the carriage assembly while keeping the counterbalance connected to the carriage assembly.

13. The sliding window assembly according to claim 12, further comprising a block and tackle interposed between the counterbalance and the window.

14. The sliding window assembly according to claim 13, wherein the block and tackle comprises:

a fixed pulley secured to the window frame;

a movable pulley displaceable in or on a track; and a pulley cable wound over the fixed pulley and the movable pulley and secured at an end to the window, wherein the counterbalance is connected between the fixed pulley and the movable pulley and is configured to bias the fixed pulley and the movable pulley apart.

15. The sliding window assembly according to claim 14, wherein the pulley cable is wrapped in multiple loops around the fixed pulley and the movable pulley.

16. A The sliding window assembly according to claim 12, wherein the cable comprises a spiral wound wire, and wherein the operating components further comprise a gear engaging the spiral wound wire, the motor engaging, the gear to drive the cable in forward and reverse directions.

* * * * *